United States Patent [19]

Flodin

[11] Patent Number: 4,537,103

[45] Date of Patent: Aug. 27, 1985

[54] ARRANGEMENT FOR A CUTTING DEVICE

[76] Inventor: Claes-Göran Flodin, Åsgatan 3, 441 51 Alingsås, Sweden

[21] Appl. No.: 530,579

[22] PCT Filed: Dec. 22, 1982

[86] PCT No.: PCT/SE82/00438

§ 371 Date: Aug. 18, 1983

§ 102(e) Date: Aug. 18, 1983

[87] PCT Pub. No.: WO83/02250

PCT Pub. Date: Jul. 7, 1983

[30] Foreign Application Priority Data

Dec. 22, 1981 [SE] Sweden ..... 8107696

[51] Int. Cl.[3] ..... B26D 1/20; B26D 7/12

[52] U.S. Cl. ..... 83/174; 83/13; 76/82; 76/85

[58] Field of Search ..... 83/174, 13; 51/246, 51/247, 250; 76/82, 85

[56] References Cited

U.S. PATENT DOCUMENTS

| | | | |
|---|---|---|---|
| 3,181,406 | 5/1965 | Sayles | 83/174 |
| 3,496,817 | 2/1970 | Staats | 83/471.2 |
| 4,088,049 | 5/1978 | Benedict | 83/471.2 |
| 4,358,975 | 11/1982 | Higgins | 83/471.2 |

FOREIGN PATENT DOCUMENTS

| | | | |
|---|---|---|---|
| 130996 | 6/1947 | Australia | 83/174 |
| 23746 | of 1894 | United Kingdom | 83/174 |

*Primary Examiner*—James M. Meister
*Assistant Examiner*—John L. Knoble

[57] ABSTRACT

A cutting device having a circular cutting blade which is mounted so that it can rotate and is supported so that it can be displaced across a web of material to be cut. This circular cutting blade is partially accommodated in a tubular member which is equipped with a slit and extends across the web of material. The member is of metal and spring-loaded so as to rotate towards the circular blade, causing it to rest against and co-act with the latter so that as the circular blade is displaced along the accommodating member with close contact it is made to rotate, while simultaneously being sharpened by the metal member.

12 Claims, 5 Drawing Figures

ARRANGEMENT FOR A CUTTING DEVICE

The present invention relates to an arrangement for a cutting device which comprises a circular cutting blade which is preferably mounted so that it can rotate freely and is supported so that it can be displaced across a web of material which it is desired to cut, consisting, for example, of a paper web which can be fed out from a roll, this circular cutting blade being partially accommodated in a tubular accommodating member which is equipped with a slit and extends across the web of material.

The main object of the present invention is primarily to provide a device of the kind described above which enables the circular blade to be made to rotate and to be sharpened as it is displaced across the web of material, without any component requiring adjustment or replacement to accomplish this.

The said object is achieved with a device according to the present invention which is primarily characterised in that the accommodating member is spring-loaded to make it rotate towards the circular blade, causing it to rest against and co-act with the latter via a metal part so that as the circular blade is being displaced along the accommodating member with the said close contact effect it is made to rotate, while simultaneously being sharpened against the said metal part.

Figure 1:
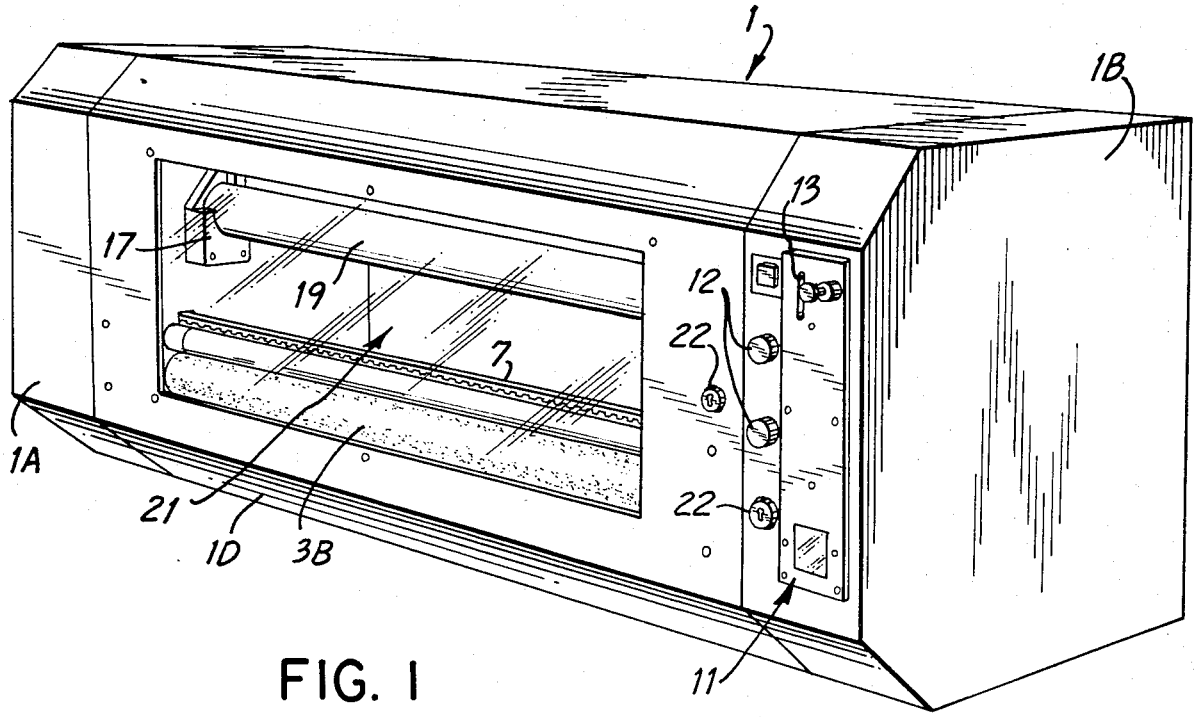
Figure 2:
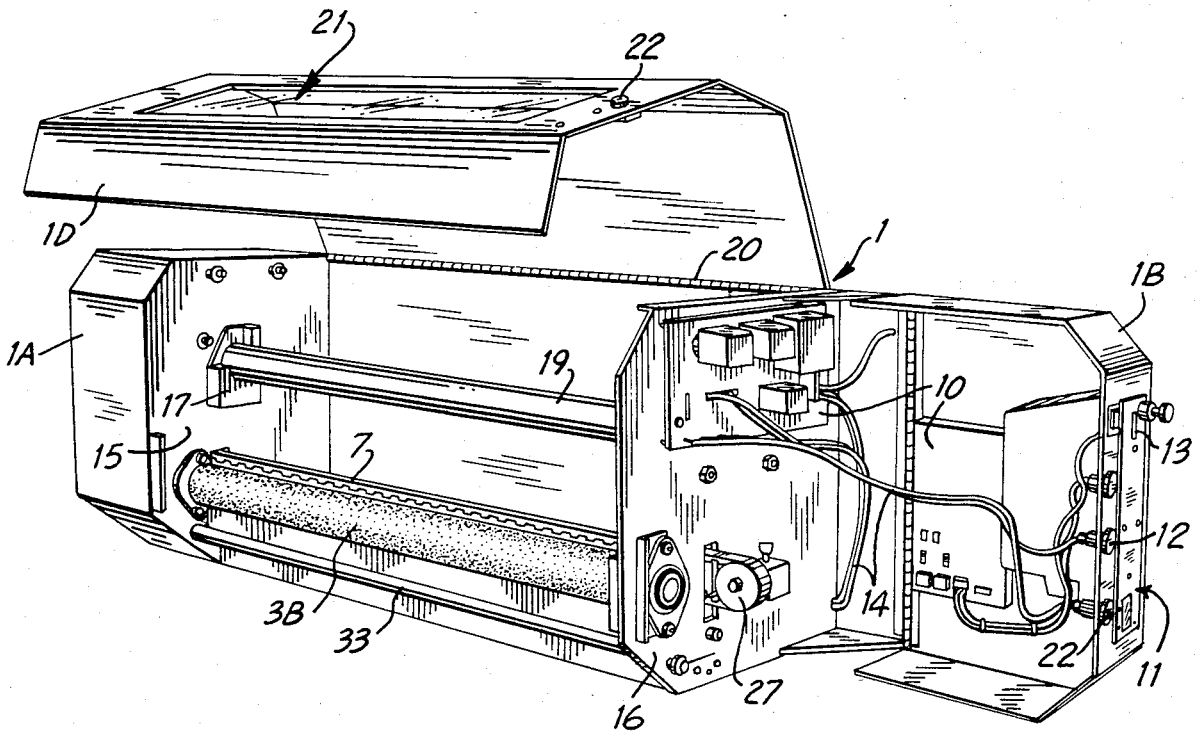
Figure 3:
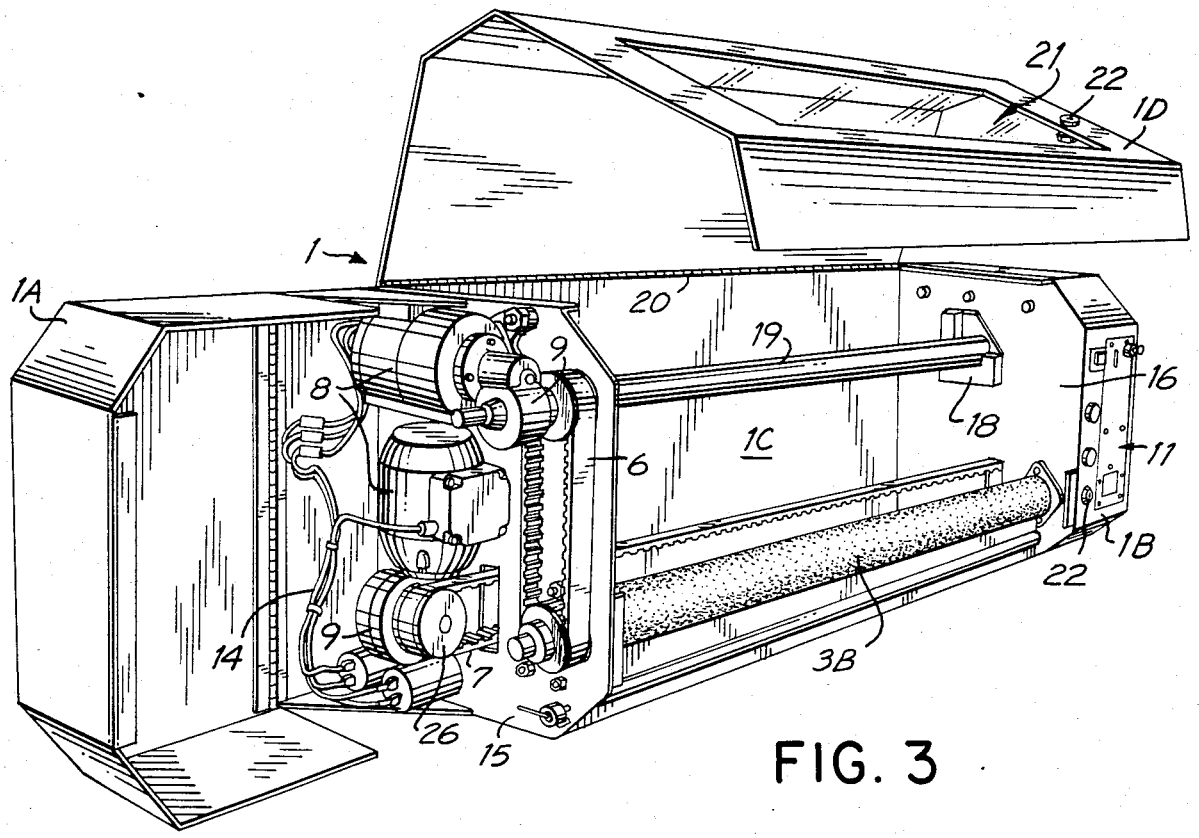
Figure 5:
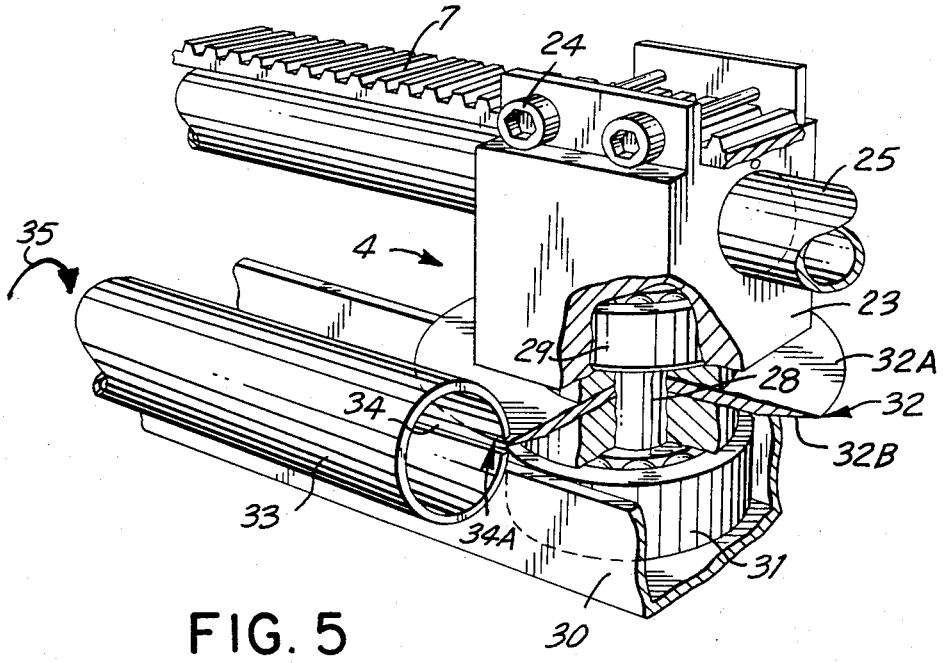
Figure 4:
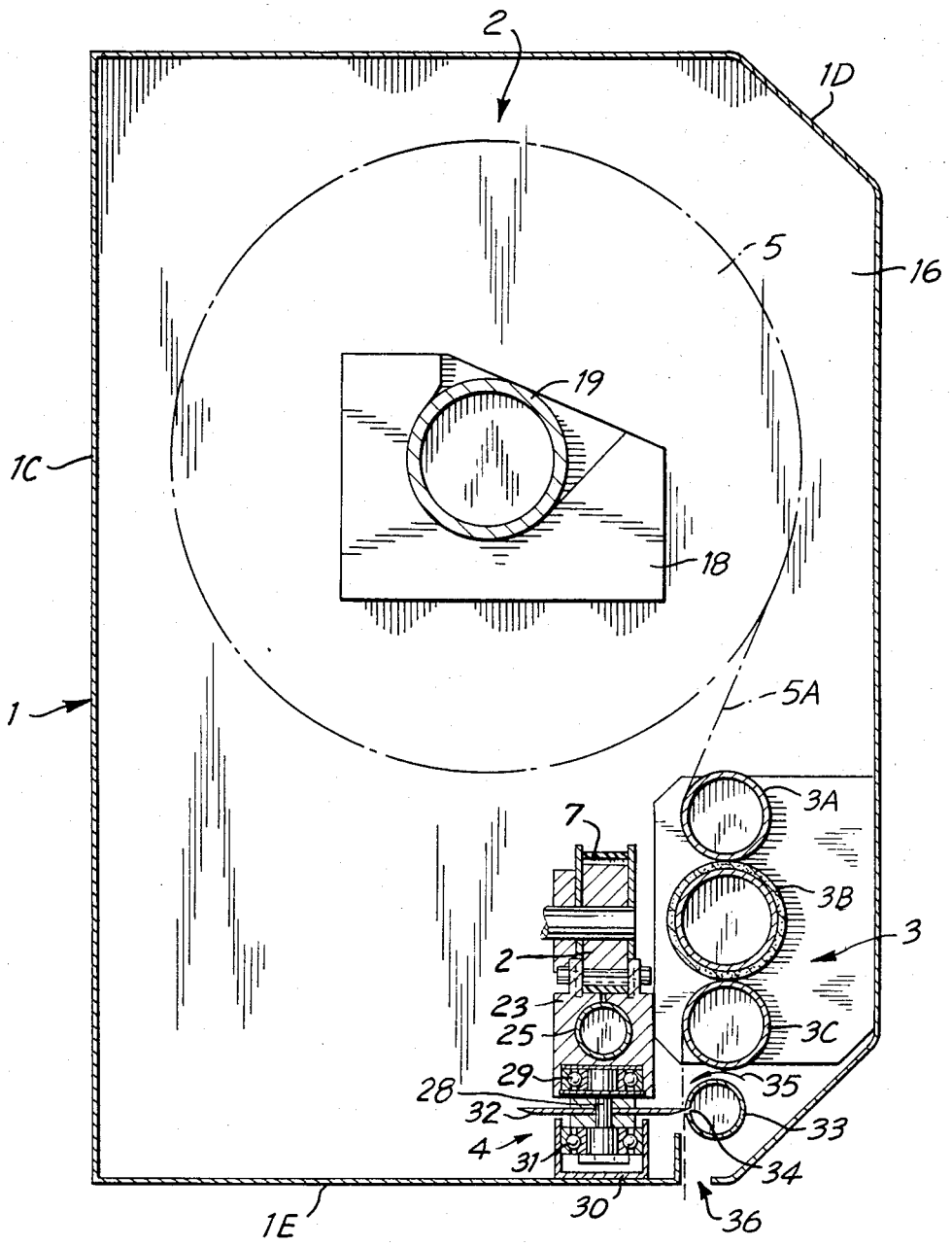

The invention is described in the following with reference to the accompanying drawings on which:

FIG. 1 shows the cutting device with an associated housing, viewed at an angle from the front, FIG. 2 shows the cutting device viewed at an angle from the front, looking from one of its ends, with parts of the housing shown partially pivoted up, FIG. 3 shows the cutting device, viewed from its other end, with parts of the housing pivoted up, FIG. 4 is a schematic cross-section view of the cutting device, and FIG. 5 shows the actual cutting device with its associated mounting, viewed at an angle to the cutting device.

Enclosed in a housing which is designated with the numeral 1 on the drawings there is a mounting arrangement 2, a feed arrangement 3 and a cutting device 4 for a web 5A of material which may be fed out, for example, from a roll 5 consisting, for example, of paper or some other suitable material. One end piece 1A of the housing 1 encloses drive devices 6 and 7 for the said feed arrangement 3 and the cutting device 4 respectively, together with, for example, a plurality of electric motors 8 with associated gears 9. The other end piece 1B of the housing encloses the collective control devices 10 and actuating devices 11 for operating the said feed and cutting devices 3, 4 respectively. The control devices 10 are composed of electrical devices such as circuit boards with their associated electrical components, for example. The actuating devices 11 expediently consist of an automatic slot mechanism 11 which is coin-operated and, by means of a plurality of control knobs 12, allows the selection of a desired amount of material to be fed out of the arrangement from the roll 5 after an appropriate quantity of coins has been inserted through the coin slot 13 of the automatic slot mechanism 11. The actuating devices 11 and the control device 10 are connected to the said drive devices 6, 7 via electrical cables 14 in a manner which is not described in detail.

The mounting arrangement 2 consists expediently of two supporting devices 17 and 18 located at a distance from each other, each of these being attached respectively to a side wall 15 or 16 projecting out from a housing part 1C which may be connected to a wall; these supporting devices 17 and 18 enable a mounting axle 19, which can co-act with a roll 5 of a material web, to be supported and a new roll 5 to be inserted rapidly.

A housing cover 1D which forms part of the housing 1, being connected to the part 1C of the housing and mounted so that it can pivot around a hinge 20, expediently has an aperture 21 through which it is possible to see, like a window, for example, enabling the roll 5 and the feed arrangement 3 to be viewed from the outside.

The feed arrangement 3 consists of a plurality of drive rollers 3A, 3B, 3C which are preferably rotatably mounted and around which the material web 5A is looped. The said rollers 3A–3C are supported at their respective ends by the said two side walls 15, 16. A central roller 3B expediently has a coating over its circumferential surface to increase its close contact with the material web 5A.

The housing cover 1D and the end pieces 1A, 1B are designed to be locked in the closed position shown in FIG. 1 by means of a plurality of locking devices 22, so as to prevent unauthorised tampering with the enclosed parts of the arrangement.

The cutting device 4 which is shown in detail in FIG. 5 will now be described in more detail so that the actual concept of the invention may be more readily understood. A holder 23 which is securely connected by means of a screw device 24, for example, to the drive device 7, which is preferably constructed as a toothed belt 7 and is provided for driving the cutting device 4, is mounted on a tube 25, for example, so that it can be displaced along the tube 25 which extends across a web 5A of material fed out from the roll 5. The said drive belt 7 is looped round and driven by toothed wheels 26 and 27 respectively, located at the two side walls 15 and 16 respectively.

On a mounting shaft 28, one end of which is supported by a roller bearing 29 connected to the holder 23, its other end being connected to a roller bearing 31 which co-acts with a guideway 30 comprised in a track which extends along the supporting tube 25, a circular cutting blade 32 is mounted, preferably so that it can rotate freely. The circular blade 32 has a straight cutting edge surface 32A and a slanting cutting edge surface 32B.

An accommodating member 33 in the form of a tube 33, preferably metal, which extends across the material web 5A and along the guideway 30 and the mounting shaft 25, and has a slit 34 extending in the longitudinal direction of the tube, is designed to accommodate part of the said circular blade 32. The tube 33 is mounted at its two ends so that it can rotate, and it is spring-loaded by spring effect devices which are not shown on the drawing, such as a spiral spring, for example, with its respective ends connected to the tube 33 and a side wall 15 or 16 respectively. The tube 33 is spring-loaded to make it rotate towards the circular blade 32 in the direction of the arrow 35, so that one side edge 34A of the slit 34 rests constantly against one cutting edge surface 32A of the circular blade.

The functioning of the device described above is basically as follows: when a sufficiently long web 5A of material has been fed out from the roll 5 past the cutting device 4 after actuation of the feed arrangement 3, the drive device 7 for the circular blade 32 is automatically actuated. The belt 7 moves the holder 23 along the supporting tube 25 at the same time as the bearing 31 rolls along the guideway 30. The circular blade 32 thus moves across the material web 5A which it is desired to cut. Co-action between the side edge 34A of the slit 34 and the cutting edge surface 32A on the circular blade 32 causes the circular blade 32 to rotate as it is being displaced. At the same time, the circular blade 32 is sharpened during its said displacement and rotation, due to the said close contact with the metal tube 33. Due to the fact that the tube 33 strives to rotate automatically towards the circular blade 32 due to the said spring-loading effect, the blade 32 is driven and sharpened as long as any material of the tube 33 remains and until it is completely worn away. At the same time the tube 33 acts to a certain extent as a protection against contact, preventing the circular blade 32 from being touched inadvertently through a delivery opening 36 in the lower face 1E of the arrangement by persons handling the equipment.

After the circular blade 32 has been moved right across all the material web 5A the device is ready again to feed out and cut off a new piece of the material web, the drive of the belt 7 being reversed so that the circular blade 32 is moved in the opposite direction.

We claim:

1. An apparatus for cutting a web of material, comprising:

a circular cutting blade having a circumferential cutting edge and being rotatable about an axis perpendicular to said blade; means for moving said cutting blade across the web so that said axis moves parallel to itself in a plane; a tubular accomodating member having a longitudinal axis extending essentially parallel to said plane and having a longitudinal slot therein defined by a metal edge receiving therein the circumferential cutting edge; and means biasing said tubular member to rotate so that said edge rests against said circumferential cutting edge; whereby said blade is rotated when said moving means moves said blade across the web and said cutting edge is sharpened.

2. An apparatus according to claim 1, wherein said tubular member is a metal tube rotatably mounted at the ends thereof.

3. An apparatus according to claim 2, wherein said biasing means rotates said metal tube in a direction corresponding to a feed direction of the web of material.

4. An apparatus according to claim 3, comprising a track extending parallel to the tube and rotatably supporting said circular cutting blade.

5. An apparatus according to claim 4, wherein said track comprises a guideway, and said circular cutting blade has a mounting displaceably guided in said guideway.

6. An apparatus according to claim 5, wherein said mounting has one end connected to a roller device rotatably mounted in said guideway, and another end connected to said moving means.

7. An apparatus according to claim 6, wherein said moving means is a drive belt looped around deflection and drive wheels respectively located at the ends of said tube.

8. An apparatus according to claim 7, wherein said drive belt is provided with teeth and said deflection and drive wheels are respectively provided with cogs.

9. An apparatus according to claim 7, comprising means for driving said drive belt and for feeding out said web of material to be cut.

10. An apparatus according to claim 9, comprising a coin-operated slot mechanism for actuating said driving means.

11. An apparatus according to claim 1, comprising a housing, and rollers for feeding said web of material to said cutting blade, said feeding rollers being arranged parallel to said tubular member, and a material delivery opening in said housing and arranged essentially parallel to said tubular member.

12. An apparatus according to claim 11, wherein said material delivery opening is spaced from said circular cutting blade sufficiently to prevent injury to a person operating said apparatus.

* * * * *